US011140764B2

(12) United States Patent
Bauer et al.

(10) Patent No.: US 11,140,764 B2
(45) Date of Patent: Oct. 5, 2021

(54) POWER SUPPLY FOR AN X-RAY EMITTER, X-RAY DEVICE AND METHOD FOR TESTING AN X-RAY DEVICE

(71) Applicant: Siemens Healthcare GmbH, Erlangen (DE)

(72) Inventors: Florian Bauer, Erlangen (DE); Andreas Boehme, Nuremberg (DE); Peter Klinger, Uttenreuth (DE)

(73) Assignee: SIEMENS HEALTHCARE GMBH, Erlangen (DE)

( * ) Notice: Subject to any disclaimer, the term of this patent is extended or adjusted under 35 U.S.C. 154(b) by 0 days.

(21) Appl. No.: 17/013,966

(22) Filed: Sep. 8, 2020

(65) Prior Publication Data

US 2021/0084740 A1 Mar. 18, 2021

(30) Foreign Application Priority Data

Sep. 16, 2019 (EP) ..... 19197484

(51) Int. Cl.

| | |
|---|---|
| ***H05G 1/26*** | (2006.01) |
| ***H05G 1/32*** | (2006.01) |
| ***H05G 1/34*** | (2006.01) |
| ***H05G 1/58*** | (2006.01) |

(52) U.S. Cl.

CPC ..... *H05G 1/265* (2013.01); *H05G 1/32* (2013.01); *H05G 1/34* (2013.01); *H05G 1/58* (2013.01)

(58) Field of Classification Search

CPC ..... H05G 1/265; H05G 1/32; H05G 1/34; H05G 1/10; H05G 1/56; H05G 1/58

See application file for complete search history.

(56) References Cited

U.S. PATENT DOCUMENTS

| | | | | |
|---|---|---|---|---|
| 3,986,033 A * | 10/1976 | Mester | ..... | H05G 1/42 378/96 |
| 4,670,893 A * | 6/1987 | Tsuchiya | ..... | H05G 1/58 378/105 |
| 5,241,260 A | 8/1993 | Beland | | |
| 2014/0205070 A1 * | 7/2014 | Caiafa | ..... | H05G 1/10 378/101 |

FOREIGN PATENT DOCUMENTS

JP H08213188 A 8/1996

* cited by examiner

*Primary Examiner* — Chih-Cheng Kao

(74) *Attorney, Agent, or Firm* — Harness, Dickey & Pierce, P.L.C.

(57) ABSTRACT

A power supply for an x-ray emitter is disclosed. A voltage source of the power supply is configured to provide an acceleration voltage or a heating voltage between a first internal contact and a second internal contact to, in a first operating mode, supply the x-ray emitter with power. The power supply includes a control device configured, in a second operating mode, to detect a voltage between the first and the second internal contact and/or to detect a current via the first and/or second internal contact. As a function of the detected voltage and/or of the detected current, the control device is configured to activate a warning device for giving a warning and/or to transmit a warning signal. A method is further disclosed.

18 Claims, 1 Drawing Sheet

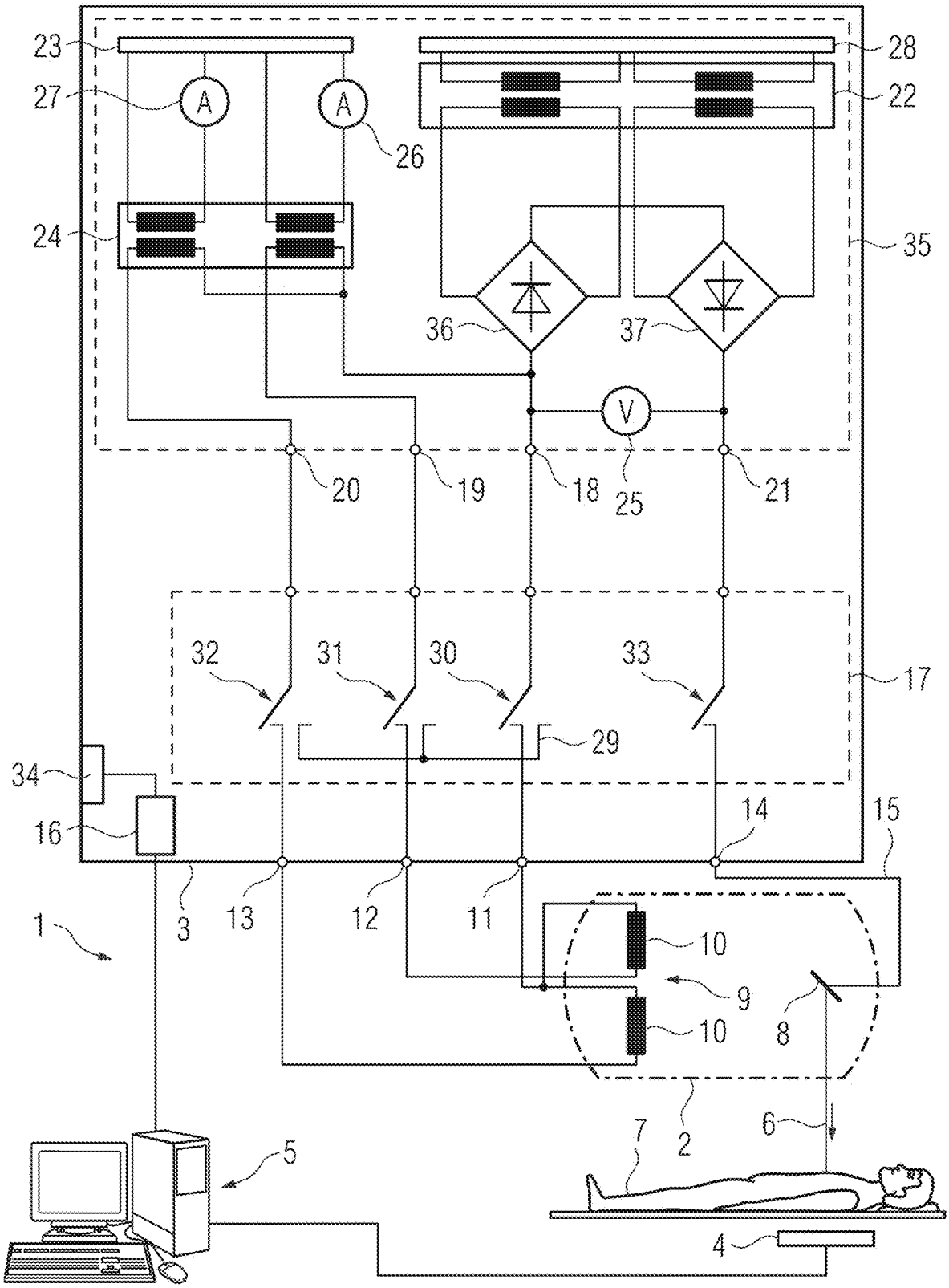
23
28
27
A
A
22
26
24
35
36
37
V
20
19
18
25
21
32
31
30
33
17
29
34
16
14
15
1
3
13
12
11
10
9
10
8
2
6
7
5
4

POWER SUPPLY FOR AN X-RAY EMITTER, X-RAY DEVICE AND METHOD FOR TESTING AN X-RAY DEVICE

PRIORITY STATEMENT

The present application hereby claims priority under 35 U.S.C. § 119 to European patent application number EP 19197484.9 filed Sep. 16, 2019, the entire contents of which are hereby incorporated herein by reference.

FIELD

Various example embodiments of the invention generally relate to a power supply for an x-ray emitter with a first and second high-voltage terminal for connection of the x-ray emitter, wherein a voltage source of the power supply is configured to provide an acceleration voltage or a heating voltage between a first internal contact and a second internal contact of the power supply, in order, in a first operating mode of the power supply, to supply power to the x-ray emitter. As well as this, embodiments of the invention generally relate to an x-ray device and also to a method for testing an x-ray device.

BACKGROUND

In x-ray devices x-ray emitters, e.g. x-ray tubes, are parts that are subject to wear. Thus it is entirely to be expected that, as part of normal operation, faults will arise at certain intervals, which can lead to a failure of the x-ray device. By monitoring the power supply corresponding problems can frequently be recognized. Thus an emitter failure is frequently attributable to a damaged filament, which can be recognized from a heating current fault. Other damage, for example short circuits, can be recognized by evaluating voltage dips.

Since a large part of the problems can be rectified by replacing the x-ray emitter, with problems in the heating circuit or with high-voltage problems it is the x-ray emitter that is replaced first of all as a rule. This however leads to power supply damage, for example a faulty heating or high-voltage transformer, only typically being detected after the x-ray emitter has been replaced and the problem still exists. Since the service engineer typically does not carry the corresponding parts with them, a second service must typically be performed, which leads to longer downtimes of the x-ray device. Moreover unnecessary additional costs can arise, since there can be an unnecessary replacement of the x-ray emitter.

As an alternative it would be possible to carry out exclusive measurements first of all to establish the source of the fault. For example external devices can be connected to make it possible to measure high voltage without the x-ray emitter being connected or to measure the heating voltage. The appropriate service resources are not always available however.

It would also be possible to change the power supply directly or to change components of the power supply, in order to test the correct functioning of the x-ray emitter. This approach too is very elaborate and demands large and heavy additional components.

SUMMARY

At least one embodiment of the invention is thus directed to an option, with little technical outlay, for achieving an improved ability to maintain an x-ray device and in particular, if there is an error present, to narrow down the possible sources of error.

At least one embodiment of the invention is directed to a power supply, comprising a control device, which is configured, in a second operating mode, to detect a voltage between the first and the second internal contact and/or a current via the first and/or the second internal contact and, depending on the voltage detected and/or the current detected, to activate a warning device for giving a warning to a user and/or to transmit a warning signal to an external device, wherein a switching device of the power supply is configured to connect the first internal contact in the first operating mode to the first high-voltage terminal and in the second operating mode to disconnect it from this terminal, and/or is configured to connect the second internal contact in the first operating mode to the second high-voltage terminal and in the second operating mode to disconnect it from the terminal, and/or is configured to connect the first and second internal contact in the second operating mode and to disconnect them in the first operating mode.

In accordance with at least one embodiment of the invention it is proposed, in a second operating mode, to disconnect at least parts of the high-voltage terminals from the assigned internal contacts and/or to connect the internal contacts to one another. A disconnection of the internal contacts from the high-voltage terminals also makes it possible to decouple the x-ray emitter from the high-voltage cables, which connect the high-voltage terminals to the x-ray emitter. This enables an influence of the external components on currents or voltages at these internal contacts to be excluded.

At least one embodiment of the invention furthermore relates to a method for testing an x-ray device, wherein an x-ray emitter, which serves to generate x-rays, is supplied with power in a first operating mode of a power supply by a first and second high-voltage terminal of the power supply, in that an acceleration voltage or a heating voltage is provided between a first internal contact and a second internal contact of the power supply, wherein the first internal contact is connected to the first high-voltage terminal and the second internal contact to the second high-voltage terminal by a switching device, wherein, when a switchover condition is fulfilled, the power supply is switched over to a second operating mode, in which the switching device disconnects the first internal contact from the first high-voltage terminal and/or the second internal contact from the second high-voltage terminal and/or connects the first and second internal contact conductively to one another, after which a current via the first and/or second internal contact and/or a voltage between the first and the second internal contact is detected by a control device and, depending on the voltage acquired and/or the current detected, a warning device for giving a warning to a user is activated and/or a warning signal is transmitted to an external device.

At least one embodiment is directed to a power supply for an x-ray emitter, comprising:

- a first high-voltage terminal and a second high-voltage terminal, for connecting to the x-ray emitter;
- a voltage source, configured to provide an acceleration voltage or a heating voltage between a first internal contact and a second internal contact of the power supply, and in a first operating mode of the power supply, to supply the x-ray emitter with power;
- a control device, configured, in a second operating mode, to detect at least one of a voltage between the first internal contact and the second internal contact and a current via at least one of the first internal contact and the second internal contact and wherein the control device, as a function of the at least one of the voltage detected and the current detected, is configured to at least one of activate a warning device for giving a warning to a user and transmit a warning signal to an external device; and a switching device, configured to at least one of connect the first internal contact, in the first operating mode, to the first high-voltage terminal and, in the second operating mode, disconnect the first internal from the first high-voltage terminal, connect, in the first operating mode, the second internal contact to the second high-voltage terminal and, in the second operating mode, disconnect the second internal contact from the second high-voltage terminal, and connect, in the second operating mode, the first internal contact and second internal contact and, in the first operating mode, disconnect the first internal contact and second internal contact.

At least one embodiment is directed to an x-ray device, comprising:

an x-ray emitter, to generate x-rays, the x-ray device including power supply of an embodiment.

At least one embodiment is directed to a method for testing an x-ray device, comprising:

supplying an x-ray emitter, to generate x-rays, with power in a first operating mode of a power supply, through a first high-voltage terminal and a second high-voltage terminal of the power supply, an acceleration voltage or a heating voltage being provided between a first internal contact and a second internal contact of the power supply, connecting the first internal contact to the first high-voltage terminal and connecting the second internal contact to the second high-voltage terminal via a switching device;

switching the power supply, upon a condition for switching being fulfilled, over to a second operating mode, in which the switching device at least one of disconnects the first internal contact from the first high-voltage terminal disconnects the second internal contact from the second high-voltage terminal, and connects the first internal contact and the second internal contact, conductively, to one another;

detecting, via a control device, at least one of a current via at least one of the first internal contact and the second internal contact and a voltage between the first internal contact and the second internal contact; and at least one of, as a function of at least one of the voltage detected and the current detected, activating a warning device for giving a warning to a user and transmitting a warning signal to an external device.

BRIEF DESCRIPTION OF THE DRAWINGS

Further advantages and details of the invention will be explained below on the basis of example embodiments as well as the associated drawings.

The FIG. 1 shows an example embodiment of an inventive x-ray device, which includes an example embodiment of an inventive power supply by which an example embodiment of the inventive method is able to be carried out.

DETAILED DESCRIPTION OF THE EXAMPLE EMBODIMENTS

The above and other elements, features, steps, and concepts of the present disclosure will be more apparent from the following detailed description in accordance with example embodiments of the invention, which will be explained with reference to the accompanying drawings.

Some examples of the present disclosure generally provide for a plurality of circuits, data storages, connections, or electrical devices such as e.g. processors. All references to these entities, or other electrical devices, or the functionality provided by each, are not intended to be limited to encompassing only what is illustrated and described herein. While particular labels may be assigned to the various circuits or other electrical devices disclosed, such labels are not intended to limit the scope of operation for the circuits and the other electrical devices. Such circuits and other electrical devices may be combined with each other and/or separated in any manner based on the particular type of electrical implementation that is desired. It is recognized that any circuit or other electrical device disclosed herein may include any number of microcontrollers, a graphics processor unit (GPU), integrated circuits, memory devices (e.g., FLASH, random access memory (RAM), read only memory (ROM), electrically programmable read only memory (EPROM), electrically erasable programmable read only memory (EEPROM), or other suitable variants thereof), and software which co-act with one another to perform operation(s) disclosed herein. In addition, any one or more of the electrical devices may be configured to execute a program code that is embodied in a non-transitory computer readable medium programmed to perform any number of the functions as disclosed.

It is to be understood that the following description of embodiments is not to be taken in a limiting sense. The scope of the invention is not intended to be limited by the embodiments described hereinafter or by the drawings, which are taken to be illustrative only.

The drawings are to be regarded as being schematic representations, and elements illustrated in the drawings are not necessarily shown to scale. Rather, the various elements are represented such that their function and general purpose become apparent to a person skilled in the art. Any connection, or communication, or coupling between functional blocks, devices, components, or other physical or functional units shown in the drawings or described herein may also be implemented by an indirect connection or coupling. A communication between devices may also be established over a wireless connection. Functional blocks may be implemented in hardware, firmware, software, or a combination thereof.

Various example embodiments will now be described more fully with reference to the accompanying drawings in which only some example embodiments are shown. Specific structural and functional details disclosed herein are merely representative for purposes of describing example embodiments. Example embodiments, however, may be embodied in various different forms, and should not be construed as being limited to only the illustrated embodiments. Rather, the illustrated embodiments are provided as examples so that this disclosure will be thorough and complete, and will fully convey the concepts of this disclosure to those skilled in the art. Accordingly, known processes, elements, and techniques, may not be described with respect to some example embodiments. Unless otherwise noted, like reference characters denote like elements throughout the attached drawings and written description, and thus descriptions will not be repeated. The present invention, however, may be embodied in many alternate forms and should not be construed as limited to only the example embodiments set forth herein.

It will be understood that, although the terms first, second, etc. may be used herein to describe various elements, components, regions, layers, and/or sections, these elements, components, regions, layers, and/or sections, should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items. The phrase "at least one of" has the same meaning as "and/or".

Spatially relative terms, such as "beneath," "below," "lower," "under," "above," "upper," and the like, may be used herein for ease of description to describe one element or feature's relationship to another element(s) or feature(s) as illustrated in the FIGURES. It will be understood that the spatially relative terms are intended to encompass different orientations of the device in use or operation in addition to the orientation depicted in the FIGURES. For example, if the device in the FIGURES is turned over, elements described as "below," "beneath," or "under," other elements or features would then be oriented "above" the other elements or features. Thus, the example terms "below" and "under" may encompass both an orientation of above and below. The device may be otherwise oriented (rotated 90 degrees or at other orientations) and the spatially relative descriptors used herein interpreted accordingly. In addition, when an element is referred to as being "between" two elements, the element may be the only element between the two elements, or one or more other intervening elements may be present.

Spatial and functional relationships between elements (for example, between modules) are described using various terms, including "connected," "engaged," "interfaced," and "coupled." Unless explicitly described as being "direct," when a relationship between first and second elements is described in the above disclosure, that relationship encompasses a direct relationship where no other intervening elements are present between the first and second elements, and also an indirect relationship where one or more intervening elements are present (either spatially or functionally) between the first and second elements. In contrast, when an element is referred to as being "directly" connected, engaged, interfaced, or coupled to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Also, the term "example" is intended to refer to an example or illustration.

When an element is referred to as being "on," "connected to," "coupled to," or "adjacent to," another element, the element may be directly on, connected to, coupled to, or adjacent to, the other element, or one or more other intervening elements may be present. In contrast, when an element is referred to as being "directly on," "directly connected to," "directly coupled to," or "immediately adjacent to," another element there are no intervening elements present.

It should also be noted that in some alternative implementations, the functions/acts noted may occur out of the order noted in the FIGURES. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Before discussing example embodiments in more detail, it is noted that some example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the FIGURE. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

Units and/or devices according to one or more example embodiments may be implemented using hardware, software, and/or a combination thereof. For example, hardware devices may be implemented using processing circuity such as, but not limited to, a processor, Central Processing Unit (CPU), a controller, an arithmetic logic unit (ALU), a digital signal processor, a microcomputer, a field programmable gate array (FPGA), a System-on-Chip (SoC), a programmable logic unit, a microprocessor, or any other device capable of responding to and executing instructions in a defined manner. Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

In this application, including the definitions below, the term 'module' or the term 'controller' may be replaced with the term 'circuit.' The term 'module' may refer to, be part of, or include processor hardware (shared, dedicated, or group) that executes code and memory hardware (shared, dedicated, or group) that stores code executed by the processor hardware.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

Software may include a computer program, program code, instructions, or some combination thereof, for independently or collectively instructing or configuring a hardware device to operate as desired. The computer program and/or program code may include program or computer-readable instructions, software components, software modules, data files, data structures, and/or the like, capable of being implemented by one or more hardware devices, such as one or more of the hardware devices mentioned above. Examples of program code include both machine code produced by a compiler and higher level program code that is executed using an interpreter.

For example, when a hardware device is a computer processing device (e.g., a processor, Central Processing Unit (CPU), a controller, an arithmetic logic unit (ALU), a digital signal processor, a microcomputer, a microprocessor, etc.), the computer processing device may be configured to carry out program code by performing arithmetical, logical, and input/output operations, according to the program code. Once the program code is loaded into a computer processing device, the computer processing device may be programmed to perform the program code, thereby transforming the computer processing device into a special purpose computer processing device. In a more specific example, when the program code is loaded into a processor, the processor becomes programmed to perform the program code and operations corresponding thereto, thereby transforming the processor into a special purpose processor.

Software and/or data may be embodied permanently or temporarily in any type of machine, component, physical or virtual equipment, or computer storage medium or device, capable of providing instructions or data to, or being interpreted by, a hardware device. The software also may be distributed over network coupled computer systems so that the software is stored and executed in a distributed fashion. In particular, for example, software and data may be stored by one or more computer readable recording mediums, including the tangible or non-transitory computer-readable storage media discussed herein.

Even further, any of the disclosed methods may be embodied in the form of a program or software. The program or software may be stored on a non-transitory computer readable medium and is adapted to perform any one of the aforementioned methods when run on a computer device (a device including a processor). Thus, the non-transitory, tangible computer readable medium, is adapted to store information and is adapted to interact with a data processing facility or computer device to execute the program of any of the above mentioned embodiments and/or to perform the method of any of the above mentioned embodiments.

Example embodiments may be described with reference to acts and symbolic representations of operations (e.g., in the form of flow charts, flow diagrams, data flow diagrams, structure diagrams, block diagrams, etc.) that may be implemented in conjunction with units and/or devices discussed in more detail below. Although discussed in a particularly manner, a function or operation specified in a specific block may be performed differently from the flow specified in a flowchart, flow diagram, etc. For example, functions or operations illustrated as being performed serially in two consecutive blocks may actually be performed simultaneously, or in some cases be performed in reverse order.

According to one or more example embodiments, computer processing devices may be described as including various functional units that perform various operations and/or functions to increase the clarity of the description. However, computer processing devices are not intended to be limited to these functional units. For example, in one or more example embodiments, the various operations and/or functions of the functional units may be performed by other ones of the functional units. Further, the computer processing devices may perform the operations and/or functions of the various functional units without sub-dividing the operations and/or functions of the computer processing units into these various functional units.

Units and/or devices according to one or more example embodiments may also include one or more storage devices. The one or more storage devices may be tangible or non-transitory computer-readable storage media, such as random access memory (RAM), read only memory (ROM), a permanent mass storage device (such as a disk drive), solid state (e.g., NAND flash) device, and/or any other like data storage mechanism capable of storing and recording data. The one or more storage devices may be configured to store computer programs, program code, instructions, or some combination thereof, for one or more operating systems and/or for implementing the example embodiments described herein. The computer programs, program code, instructions, or some combination thereof, may also be loaded from a separate computer readable storage medium into the one or more storage devices and/or one or more computer processing devices using a drive mechanism. Such separate computer readable storage medium may include a Universal Serial Bus (USB) flash drive, a memory stick, a Blu-ray/DVD/CD-ROM drive, a memory card, and/or other like computer readable storage media. The computer programs, program code, instructions, or some combination thereof, may be loaded into the one or more storage devices and/or the one or more computer processing devices from a remote data storage device via a network interface, rather than via a local computer readable storage medium. Additionally, the computer programs, program code, instructions, or some combination thereof, may be loaded into the one or more storage devices and/or the one or more processors from a remote computing system that is configured to transfer and/or distribute the computer programs, program code, instructions, or some combination thereof, over a network. The remote computing system may transfer and/or distribute the computer programs, program code, instructions, or some combination thereof, via a wired interface, an air interface, and/or any other like medium.

The one or more hardware devices, the one or more storage devices, and/or the computer programs, program code, instructions, or some combination thereof, may be specially designed and constructed for the purposes of the example embodiments, or they may be known devices that are altered and/or modified for the purposes of example embodiments.

A hardware device, such as a computer processing device, may run an operating system (OS) and one or more software applications that run on the OS. The computer processing device also may access, store, manipulate, process, and create data in response to execution of the software. For simplicity, one or more example embodiments may be exemplified as a computer processing device or processor; however, one skilled in the art will appreciate that a hardware device may include multiple processing elements or processors and multiple types of processing elements or processors. For example, a hardware device may include multiple processors or a processor and a controller. In addition, other processing configurations are possible, such as parallel processors.

The computer programs include processor-executable instructions that are stored on at least one non-transitory computer-readable medium (memory). The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc. As such, the one or more processors may be configured to execute the processor executable instructions.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

Further, at least one embodiment of the invention relates to the non-transitory computer-readable storage medium including electronically readable control information (processor executable instructions) stored thereon, configured in such that when the storage medium is used in a controller of a device, at least one embodiment of the method may be carried out.

The computer readable medium or storage medium may be a built-in medium installed inside a computer device main body or a removable medium arranged so that it can be separated from the computer device main body. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The term code, as used above, may include software, firmware, and/or microcode, and may refer to programs, routines, functions, classes, data structures, and/or objects. Shared processor hardware encompasses a single microprocessor that executes some or all code from multiple modules. Group processor hardware encompasses a microprocessor that, in combination with additional microprocessors, executes some or all code from one or more modules. References to multiple microprocessors encompass multiple microprocessors on discrete dies, multiple microprocessors on a single die, multiple cores of a single microprocessor, multiple threads of a single microprocessor, or a combination of the above.

Shared memory hardware encompasses a single memory device that stores some or all code from multiple modules. Group memory hardware encompasses a memory device that, in combination with other memory devices, stores some or all code from one or more modules.

The term memory hardware is a subset of the term computer-readable medium. The term computer-readable medium, as used herein, does not encompass transitory electrical or electromagnetic signals propagating through a medium (such as on a carrier wave); the term computer-readable medium is therefore considered tangible and non-transitory. Non-limiting examples of the non-transitory computer-readable medium include, but are not limited to, rewriteable non-volatile memory devices (including, for example flash memory devices, erasable programmable read-only memory devices, or a mask read-only memory devices); volatile memory devices (including, for example static random access memory devices or a dynamic random access memory devices); magnetic storage media (including, for example an analog or digital magnetic tape or a hard disk drive); and optical storage media (including, for example a CD, a DVD, or a Blu-ray Disc). Examples of the media with a built-in rewriteable non-volatile memory, include but are not limited to memory cards; and media with a built-in ROM, including but not limited to ROM cassettes; etc. Furthermore, various information regarding stored images, for example, property information, may be stored in any other form, or it may be provided in other ways.

The apparatuses and methods described in this application may be partially or fully implemented by a special purpose computer created by configuring a general purpose computer to execute one or more particular functions embodied in computer programs. The functional blocks and flowchart elements described above serve as software specifications, which can be translated into the computer programs by the routine work of a skilled technician or programmer.

Although described with reference to specific examples and drawings, modifications, additions and substitutions of example embodiments may be variously made according to the description by those of ordinary skill in the art. For example, the described techniques may be performed in an order different with that of the methods described, and/or components such as the described system, architecture, devices, circuit, and the like, may be connected or combined to be different from the above-described methods, or results may be appropriately achieved by other components or equivalents.

At least one embodiment of the invention is directed to a power supply, comprising a control device, which is configured, in a second operating mode, to detect a voltage between the first and the second internal contact and/or a current via the first and/or the second internal contact and, depending on the voltage detected and/or the current detected, to activate a warning device for giving a warning to a user and/or to transmit a warning signal to an external device, wherein a switching device of the power supply is configured to connect the first internal contact in the first operating mode to the first high-voltage terminal and in the second operating mode to disconnect it from this terminal, and/or is configured to connect the second internal contact in the first operating mode to the second high-voltage terminal and in the second operating mode to disconnect it from the terminal, and/or is configured to connect the first and second internal contact in the second operating mode and to disconnect them in the first operating mode.

In accordance with at least one embodiment of the invention it is proposed, in a second operating mode, to disconnect at least parts of the high-voltage terminals from the assigned internal contacts and/or to connect the internal contacts to one another. A disconnection of the internal contacts from the high-voltage terminals also makes it possible to decouple the x-ray emitter from the high-voltage cables, which connect the high-voltage terminals to the x-ray emitter. This enables an influence of the external components on currents or voltages at these internal contacts to be excluded.

If for example a voltage dip between the first and second contact in the first operating mode is recognized, any external fault can be excluded by the disconnection of at least one of the high-voltage terminals, preferably of all high-voltage terminals, from the respective internal contacts. If in the second operating mode a voltage dip is thus still recognized, this indicates an internal error, for example an internal short circuit or a damaged transformer. If on the other hand a voltage dip no longer occurs in the second operating mode, it can be assumed that it is caused by external components, i.e. the x-ray emitter or the high-voltage cables connecting this to the high-voltage terminals. The use of the second operating mode thus enables a distinction to be made between internal damage to the power supply and external faults, for example leakages or short circuits.

As has already been explained above, a further frequent problem is that of detecting heating current faults, in particular a heating current that is too low. This can be caused by damage to heating filaments of the x-ray emitter, but also by damage to the power supply however, for example a damaged low-voltage transformer, which is intended to provide the heating current. A conductive connection between the first and second internal contact, either directly or via a defined resistance or a defined impedance, enables a correctly functioning heating of an x-ray emitter, in particular a correctly functioning heating filament, to be simulated. Thus if a heating current that is too low or another fault of the heating current is also measured in the second operating mode, this is a strong indicator that the power supply or its components are damaged. If on the other hand the heating current fault is remedied by the switchover to the second operating mode, the assumption can be made that there is a problem external to the power supply, in particular a damaged heating filament.

The first and second high-voltage terminal can serve to supply power to different electrodes of the x-ray emitter, i.e. to supply power to the cathode and the anode. In this case high voltages are present between the first and second internal contact, in particular high DC voltages. Damage to the power supply, the x-ray emitter and the high-voltage cable in this case can in particular lead to voltage dips, so that in this case a voltage measurement is preferably undertaken. In order to exclude external influences on the power supply, both internal contacts should be preferably be disconnected from the respective high-voltage terminals. A connection of the first and second internal contact to one another is not especially expedient in this case.

It is also possible for the first and second high-voltage terminal to be used to apply a heating voltage to the x-ray emitter. In this case it can be especially advantageous to check whether sufficient current is flowing via the first or second internal contact. In this case the current that is flowing via the first and/or the second contact is thus especially preferably measured. As explained above, the first and second internal contact can be connected conductively in the second operating mode, in order to simulate a correctly functioning heating filament and thus to detect whether internal damage to the power supply is present.

Giving a warning or transmitting the warning signal can occur in particular when a warning condition is fulfilled, for example when a voltage detected or a current detected is smaller than a respective limit value. As an alternative the content of the warning given or of the warning signal can also depend on the fulfillment of the warning condition.

Relatively high acceleration voltages are used for x-ray emitters, in particular in the medical field. Thus the potential difference between the first and second internal contact or in particular in the first operating mode between the first and second high-voltage terminal can amount to several tens of kV or more than 100 kV. For example acceleration voltages between 10 and 150 kV are usual. For example 125 kV, but also 260 kV or more, can be used as the acceleration voltage. The acceleration voltage can be controlled for example by an input voltage of a high-voltage transformer being varied. In order to recognize leakages in a robust manner, it can be advantageous, before a voltage measurement for recognition of defects, to set a maximum output voltage or to measure voltages dropping between the first and second internal contact for a number of desired output voltages.

The voltage source can have a further internal contact and can be configured to apply an acceleration voltage between the further internal contact and the first and/or second internal contact, wherein the switching device is configured to connect the further internal contact in the first operating mode to a further high-voltage terminal and in the second operating mode to disconnect it from the terminal. In particular in this case a heating voltage can be applied between the first and second internal contact. The high-voltage terminals for providing a heating voltage, in the first operating mode, thus at the same time represent an opposing potential for the acceleration voltage. This is known per se in the prior art and will therefore not be explained in any greater detail. Through the proposed option of also disconnecting the further internal contact from the assigned high-voltage terminal and thus from the x-ray emitter, the power supply can thus in particular be completely decoupled from the x-ray emitter or from the high-voltage cables connecting this to the power supply, whereby a robust distinction between internal errors of the power supply and external errors, for example of the cables or the x-ray emitter, can be achieved.

The described numbers of high-voltage terminals or internal contacts are not restrictive. For example three or also more high-voltage terminals can be routed to a cathode of the x-ray emitter, in order to feed a number of heating filaments. In an especially advantageous embodiment all high-voltage terminals of the power supply, which couple the supply to the x-ray emitter, can be disconnected from the associated internal contacts and/or all internal contacts, which serve to provide a heating voltage or a heating current, can be connected to one another in the second operating mode.

The power supply can be used for the simultaneous or alternate supplying of power to a number of x-ray emitters. In the first operating mode the high-voltage terminals for a selected emitter of the x-ray emitters or for both x-ray emitters can be connected by a switching device to their assigned internal contacts in each case. In the second operating mode the high-voltage terminals for all x-ray emitters can be disconnected from the internal contacts.

An AC voltage in particular can be used as the heating voltage. The heating voltage or the amplitude of the heating voltage can be significantly smaller than the acceleration voltage provided by the power supply, in particular smaller by at least a factor of 10 or 100.

The control device can be configured, in the second operating mode, to detect a voltage between the further internal contact and the first or second internal contact, wherein the activation of the warning device and/or the transmission of the warning signal additionally depends on this voltage. In particular the correct provision of the acceleration voltage by the power supply can be checked in this way, wherein at the same time or also at another point in time, as explained above, the correct provision of a heating voltage or of a heating current can be checked.

The control device can be configured, in the first operating mode, to detect the current via the first and/or second internal contact and/or the voltage between the first and the second internal contact and/or the voltage between the further and the first and/or second internal contact as the respective measurement variable, and on fulfillment of a switching condition, which depends on the measurement variable or the measurement variables, to switch over the power supply to the second operating mode. A switchover into the second operating mode can take place in particular when the detected voltage or the detected current fall below a respective threshold value or are recognized as faulty in another way, for example because of sudden changes.

The switchover condition being fulfilled can indicate that there is a fault in the provision of an acceleration voltage or heating voltage or a heating current. As explained in the introduction, this can have external causes, i.e. in particular damage to the x-ray emitter or the high-voltage cable, or internal causes, for example damage to a heating or acceleration voltage transformer. The method described, when a possible error is recognized, enables a switchover to be made to the second operating mode, in order to check whether an internal error of the power supply is present. Subsequently a corresponding warning can be given to a user or a warning signal transmitted to an external device, which can comprise appropriate information. Thus for example information can be provided immediately as to whether an internal or an external defect is present. On the basis of this information it can be made possible for the probable correct spare parts to be provided immediately or expensive measurements by a service engineer can be avoided. Overall in this way a shorter maintenance interval of an x-ray device can be achieved when an error occurs and a part of the costs can be saved.

In addition or as an alternative to the automatic switchover to the second operating mode described above, it can also be possible to trigger operation in the second operating mode manually at the power supply or at a device communicating with the supply, for example a control processor of an x-ray device. For example it can be expedient to test functions of the power supply as part of an installation or maintenance independently of errors already recognized previously.

The switching facility can comprise a first oil switch, which in the first operating mode connects the first internal contact to the first high-voltage terminal and in the second operating mode disconnects it from the terminal, and/or a second oil switch, which in the first operating mode connects the second internal contact to the second high-voltage terminal and in the second operating mode disconnects it from the terminal. In particular all switching processes explained, i.e. in particular also the connection of internal contacts of the power supply, can be realized by oil switches. Oil switches are power switches in which the switch is located in a vessel filled with oil. The oil serves in such cases to extinguish the switching arc occurring during a switching process. Oil switches are known in the prior art and will not be described in detail.

Provided that, in the inventive power supply, the high-voltage terminals are disconnected from the respective assigned internal contacts, the high-voltage terminals can lie at a floating potential. It is also possible however to pull the high-voltage terminals to a defined potential, for example a ground potential.

As well as relating to the inventive power supply, the invention relates to an x-ray device, in particular for medical imaging, with an x-ray emitter for generating x-rays, wherein the x-ray device includes an inventive power supply.

At least one embodiment of the invention furthermore relates to a method for testing an x-ray device, wherein an x-ray emitter, which serves to generate x-rays, is supplied with power in a first operating mode of a power supply by a first and second high-voltage terminal of the power supply, in that an acceleration voltage or a heating voltage is provided between a first internal contact and a second internal contact of the power supply, wherein the first internal contact is connected to the first high-voltage terminal and the second internal contact to the second high-voltage terminal by a switching device, wherein, when a switchover condition is fulfilled, the power supply is switched over to a second operating mode, in which the switching device disconnects the first internal contact from the first high-voltage terminal and/or the second internal contact from the second high-voltage terminal and/or connects the first and second internal contact conductively to one another, after which a current via the first and/or second internal contact and/or a voltage between the first and the second internal contact is detected by a control device and, depending on the voltage acquired and/or the current detected, a warning device for giving a warning to a user is activated and/or a warning signal is transmitted to an external device.

As already explained for the inventive power supply, the fulfillment of the condition for switchover can depend on the detected current or the detected voltage. In addition or as an alternative the fulfillment of the condition for switchover can depend on a voltage between a further internal contact and the first or second internal contact, as has likewise already been explained for the inventive power supply. The condition for switchover can however also be fulfilled if a manual switch to the second operating mode has been initiated, for example by an operating element on the power supply or by a further component of the measuring device or by a signal of an external device, for example by a remote request from a service engineer or the like.

The various features explained for the power supply can be transferred, along with the advantages stated for them, to the inventive method. In particular the giving of the warning or the transmission of the warning signal can depend on a further voltage, which drops between the first or second internal contact and a further internal contact. The further internal contact can initially be connected in the first operating mode to a further high-voltage terminal of the power supply and be disconnected by the switching device from the terminal in the second operating mode.

FIG. 1 shows an x-ray device 1, which can be used for example for medical imaging. X-rays 6 are generated by an x-ray emitter 2, which, after they have passed through an examination object 7, for example a patient, strike an x-ray detector 4. Through a device 5, for example a control and/or evaluation processor of the x-ray device 1, the measurement data of the x-ray detector 4 can be detected and for example used for imaging. Moreover the device 5 controls the power supply 3 of the x-ray device 1, in order to supply power to the x-ray emitter 2.

The power is supplied to the x-ray emitter 2 on the one hand via a first, second and third high-voltage terminal 11, 12, 13 of the power supply 3, via which power is supplied to the filaments 10 of the cathode 9 of the x-ray emitter in order to heat up the cathode 9. A voltage is applied to the anode 8 on the other hand via a further high-voltage terminal 14 such that a high acceleration voltage of for example 125 kV is present between the cathode 9 and the anode 8. Through this acceleration voltage electrons emerging from the hot cathode are accelerated in the direction of the anode 8 and strike the latter at high speed and thus generate the x-rays 6. A fixed anode is shown in FIG. 1 for reasons of clarity, wherein typically rotating anodes are used. The method described for generation of x-rays is known in principle and will therefore not be described in any greater detail.

With such x-ray devices 1 a certain degree of wear on the x-ray emitter 2 is to be expected. In particular the filaments 10 can become damaged and no longer allow sufficient heating of the cathode 9 or, as a result of the high voltages used, leakages can occur, whereby the acceleration voltage dips. In both cases a robust generation of x-rays 6 is no longer possible, which is why the damaged components should be replaced within the framework of a service. Damage to the filaments 10 can be recognized in particular by heating currents being detected by a control device 16 of the power supplied 3 via an ammeter 26, 27, 28. A heating current that is too low indicates damage to a filament 10. The problem here is that damage to the filament 10 and thus an external error cannot be readily distinguished from damage to the power supply 3, for example to the transformer 24 for the heating currents.

Short circuits or leakages in the x-ray emitter 2 or in high-voltage cables 15 on the other hand can be detected by monitoring of the acceleration voltage by the voltmeter 25. Here too however external leakages and short circuits cannot be distinguished from external leakages and short circuits of the power supply 3 or for example from damage to the transformer 22 for the high voltage.

In order to make possible such a distinction between internal and external damage and thus in particular to make possible a faster or better service of the x-ray device 1, the power supply 3 can be operated in two different operating modes. In a first operating mode heating voltages and an acceleration voltage are provided as usual for the x-ray emitter 3. To provide an acceleration voltage, first of all by a preliminary stage 38, which is constructed in the usual manner and will not be explained in any greater detail, an AC voltage is supplied, which is transformed into a high voltage via the transformer 22, which is rectified by the rectifiers 36, 37 and is provided at a first and further internal contact 18, 21 of the voltage source 35. In the first operating mode a switching device 17 connects the first internal contact 18 to the first high-voltage terminal 11 and the further internal contact 21 to the further high-voltage terminal 14.

To provide the heating voltage AC voltages are provided once again by an input stage 23 known per se, which will not be explained in any greater detail, which are transformed by the transformer 24, so that a heating voltage between the first internal contact 18 and the second and third internal contact 19, 20 results. The second internal contact is connected via the switching device 17 to the second high-voltage terminal 12 and the third internal contact 20 is connected via the switching device 17 to the third high-voltage terminal 13. Thus the supply of power to the x-ray emitter 2 corresponds in the first operating mode to the usual way in which power is supplied to an x-ray emitter.

If it is recognized within the framework of operation in the first operating mode that the heating current or the acceleration voltage is faulty, for example because the voltage detected via the voltmeter 25 between the internal contacts 18 and 21 or the currents detected via the ammeter 26, 27, 28 via the internal contacts 18, 19, 20 exceed a threshold value or vary suddenly, then this indicates that either one of the external components, i.e. in particular the x-ray emitter 2 or one of the high-voltage cables 15, or the power supply 3 or one of its components is damaged.

In order to recognize whether an internal or external error is present, the control device 16 can switch the power supply 3 in this case into a second operating mode. In this mode the switching device 17 disconnects all internal contacts 18, 19, 20, 21 from the high-voltage terminals 11, 12, 13, 14 assigned to them in each case. This leads to the voltage between the internal contact points 18 and 21 detected via the voltmeter 25 being independent in the second operating mode of the state of the external components, i.e. the x-ray emitter 2 and the high-voltage cable 15. If a fault in this voltage, i.e. for example a value that is too low or a sudden change, continues to be detected, this indicates that the power supply 3 and in particular the transformer 22 could be damaged. If on the other hand after the switchover into the second operating mode the acceleration voltage fault is rectified, this indicates that this fault is caused by an external component, i.e. in particular by the x-ray emitter 2 or the high-voltage cable 15.

In the second operating mode the first internal contact 18 is additionally short circuited via the short-circuit bridge 29 of the switching device 17 to the second and third internal contact 19, 20. Through this a flow of current through the internal contacts 18, 19, 20 and thus through the ammeter 26, 27, 28 is approximately reached, as would be reached if an x-ray emitter 2 with correctly functioning filaments 10 were connected. If the measured current values that are detected via the ammeters 26, 27, 28 continue to indicate a heating current fault in the second operating mode, this indicates damage to the power supply, in particular to the transformer 24. If on the other hand the heating current fault is no longer present in the second operating mode, it is likely to be caused by a damaged external component, in particular by a damaged filament 10.

Depending on the voltage and currents detected in the second operating mode it can thus be decided whether there is likely to be an internal or an external defect present. In order to communicate this to a user, a warning device 34 of the power supply 3 can be activated for example or a warning signal can be transmitted to the external device 5, in order to draw a user's attention to this. While in the example shown there is only a local signal transmission, it is also possible to send a message directly to a service technician for example. This is possible by transmitting a text message, sending an e-mail or the like for example.

The switching device 17 can be formed by a number of switches, in particular oil switches 30, 31, 32, 33. Using oil switches 30, 31, 32, 33 makes it possible to switch the high voltages that occur in a robust manner. The oil switches 30, 31, 32 can be toggle switches, which switch between a connection of the respective internal contact 18, 19, 20 to the respective high-voltage terminal 11, 12, 13 and a connection of the respective internal contact 18, 19, 20 to the short-circuit bridge 29. The oil switch 33 can serve exclusively to disconnect the internal contact 21 from the high-voltage terminal 14.

Further, in at least one embodiment, a method for testing an x-ray device comprises:

supplying an x-ray emitter, to generate x-rays, with power in a first operating mode of a power supply, through a first high-voltage terminal and a second high-voltage terminal of the power supply, an acceleration voltage or a heating voltage being provided between a first internal contact and a second internal contact of the power supply, connecting the first internal contact to the first high-voltage terminal and connecting the second internal contact to the second high-voltage terminal via a switching device;

switching the power supply, upon a condition for switching being fulfilled, over to a second operating mode, in which the switching device at least one of disconnects the first internal contact from the first high-voltage terminal disconnects the second internal contact from the second high-voltage terminal, and connects the first internal contact and the second internal contact, conductively, to one another;

detecting, via a control device, at least one of a current via at least one of the first internal contact and the second internal contact and a voltage between the first internal contact and the second internal contact; and at least one of, as a function of at least one of the voltage detected and the current detected, activating a warning device for giving a warning to a user and transmitting a warning signal to an external device.

Although the invention has been illustrated and described in greater detail by the preferred example embodiment, the invention is not restricted by the disclosed examples and other variations can be derived herefrom by the person skilled in the art, without departing from the scope of protection of the invention.

The invention was illustrated and described herein before in detail with reference to example embodiments. It is understood that in particular the description with reference to the FIGURES is for illustrative purposes only and shall not be interpreted in a limiting sense. Variations and combinations may be derived from the information disclosed herein before by the skilled person without departing form the scope or core ideas of present the invention, which are in particular reflected in the appended claims.

Although the invention has been illustrated in greater detail using the example embodiments, the invention is not limited by the disclosed examples, and a person skilled in the art can derive other variations therefrom without departing from the scope of protection of the invention.

The patent claims of the application are formulation proposals without prejudice for obtaining more extensive patent protection. The applicant reserves the right to claim even further combinations of features previously disclosed only in the description and/or drawings.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

None of the elements recited in the claims are intended to be a means-plus-function element within the meaning of 35

U.S.C. § 112(f) unless an element is expressly recited using the phrase "means for" or, in the case of a method claim, using the phrases "operation for" or "step for."

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A power supply for an x-ray emitter, comprising:

a first high-voltage terminal and a second high-voltage terminal, for connecting to the x-ray emitter;

a voltage source, configured to provide an acceleration voltage or a heating voltage between a first internal contact and a second internal contact of the power supply, and in a first operating mode of the power supply, to supply the x-ray emitter with power;

a control device, configured, in a second operating mode, to detect at least one of a voltage between the first internal contact and the second internal contact and a current via at least one of the first internal contact and the second internal contact and wherein the control device, as a function of the at least one of the voltage detected and the current detected, is configured to at least one of activate a warning device for giving a warning to a user and transmit a warning signal to an external device; and a switching device, configured to at least one of connect the first internal contact, in the first operating mode, to the first high-voltage terminal and, in the second operating mode, disconnect the first internal contact from the first high-voltage terminal, connect, in the first operating mode, the second internal contact to the second high-voltage terminal and, in the second operating mode, disconnect the second internal contact from the second high-voltage terminal, and connect, in the second operating mode, the first internal contact and second internal contact and, in the first operating mode, disconnect the first internal contact and second internal contact.

2. The power supply of claim 1, wherein the voltage source includes a further internal contact and is configured to apply an acceleration voltage between the further internal contact and at least one of the first internal contact and the second internal contact, wherein the switching device is configured to connect the further internal contact in the first operating mode to a further high-voltage terminal and wherein the switching device, in the second operating mode, is configured to disconnect the further internal contact from the further high-voltage terminal.

3. The power supply of claim 2, wherein the control device is configured, in the second operating mode, to detect a voltage between the further internal contact and the first internal contact or the second internal contact, and wherein the at least one of the activation of the warning device and the transmission of the warning signal additionally depends on the voltage detected between the further internal contact and the first internal contact or the second internal contact.

4. The power supply of claim 1, wherein the control device is configured, in the first operating mode, to detect at least one of the current, via the at least one of the first internal contact and second internal contact and the voltage between the first internal contact and the second internal contact, and the voltage between a further internal contact and at least one of the first internal contact and the second internal contact as a respective measurement variable, and wherein, when a condition for switching is fulfilled, depending on the measurement variable or measurement variables, the control device is configured to switchover the power supply to the second operating mode.

5. The power supply of claim 2, wherein the control device is configured, in the first operating mode, to detect at least one of the current, via the at least one of the first internal contact and second internal contact and the voltage between the first internal contact and the second internal contact, and the voltage between the further internal contact and at least one of the first internal contact and the second internal contact as a respective measurement variable, and wherein, when a condition for switching is fulfilled, depending on the measurement variable or measurement variables, the control device is configured to switchover the power supply to the second operating mode.

6. The power supply of claim 3, wherein the control device is configured, in the first operating mode, to detect at least one of the current, via the at least one of the first internal contact and second internal contact and the voltage between the first internal contact and the second internal contact, and the voltage between the further internal contact and at least one of the first internal contact and the second internal contact as a respective measurement variable, and wherein, when a condition for switching is fulfilled, depending on the measurement variable or measurement variables, the control device is configured to switchover the power supply to the second operating mode.

7. The power supply of claim 1, wherein the switching device comprises at least one of a first oil switch to, in the first operating mode, connect the first internal contact to the first high-voltage terminal and to, in the second operating mode, disconnect the first internal contact from the first high-voltage terminal, and a second oil switch to, in the first operating mode, connect the second internal contact to the second high-voltage terminal and to, in the second operating mode, disconnect the second internal contact from the second high-voltage terminal.

8. The power supply of claim 2, wherein the switching device comprises at least one of a first oil switch to, in the first operating mode, connect the first internal contact to the first high-voltage terminal and to, in the second operating mode, disconnect the first internal contact from the first high-voltage terminal, and a second oil switch to, in the first operating mode, connect the second internal contact to the second high-voltage terminal and to, in the second operating mode, disconnect the second internal contact from the second high-voltage terminal.

9. The power supply of claim 3, wherein the switching device comprises at least one of a first oil switch to, in the first operating mode, connect the first internal contact to the first high-voltage terminal and to, in the second operating mode, disconnect the first internal contact from the first high-voltage terminal, and a second oil switch to, in the first operating mode, connect the second internal contact to the second high-voltage terminal and to, in the second operating mode, disconnect the second internal contact from the second high-voltage terminal.

10. The power supply of claim 4, wherein the switching device comprises at least one of a first oil switch to, in the first operating mode, connect the first internal contact to the first high-voltage terminal and to, in the second operating mode, disconnect the first internal contact from the first high-voltage terminal, and a second oil switch to, in the first operating mode, connect the second internal contact to the second high-voltage terminal and to, in the second operating mode, disconnect the second internal contact from the second high-voltage terminal.

11. The power supply of claim 5, wherein the switching device comprises at least one of a first oil switch to, in the first operating mode, connect the first internal contact to the first high-voltage terminal and to, in the second operating mode, disconnect the first internal contact from the first high-voltage terminal, and a second oil switch to, in the first operating mode, connect the second internal contact to the second high-voltage terminal and to, in the second operating mode, disconnect the second internal contact from the second high-voltage terminal.

12. The power supply of claim 6, wherein the switching device comprises at least one of a first oil switch to, in the first operating mode, connect the first internal contact to the first high-voltage terminal and to, in the second operating mode, disconnect the first internal contact from the first high-voltage terminal, and a second oil switch to, in the first operating mode, connect the second internal contact to the second high-voltage terminal and to, in the second operating mode, disconnect the second internal contact from the second high-voltage terminal.

13. An x-ray device, comprising:

an x-ray emitter, to generate x-rays, the x-ray device including the power supply of claim 1.

14. An x-ray device, comprising:

an x-ray emitter, to generate x-rays, the x-ray device including the power supply of claim 2.

15. An x-ray device, comprising:

an x-ray emitter, to generate x-rays, the x-ray device including the power supply of claim 3.

16. An x-ray device, comprising:

an x-ray emitter, to generate x-rays, the x-ray device including the power supply of claim 4.

17. An x-ray device, comprising:

an x-ray emitter, to generate x-rays, the x-ray device including the power supply of claim 7.

18. A method for testing an x-ray device, comprising:

supplying an x-ray emitter, to generate x-rays, with power in a first operating mode of a power supply, through a first high-voltage terminal and a second high-voltage terminal of the power supply, an acceleration voltage or a heating voltage being provided between a first internal contact and a second internal contact of the power supply, connecting the first internal contact to the first high-voltage terminal and connecting the second internal contact to the second high-voltage terminal via a switching device;

switching the power supply, upon a condition for switching being fulfilled, over to a second operating mode, in which the switching device at least one of disconnects the first internal contact from the first high-voltage terminal, disconnects the second internal contact from the second high-voltage terminal, and connects the first internal contact and the second internal contact, conductively, to one another;

detecting, via a control device, at least one of a current via at least one of the first internal contact and the second internal contact and a voltage between the first internal contact and the second internal contact; and at least one of, as a function of at least one of the voltage detected and the current detected, activating a warning device for giving a warning to a user and transmitting a warning signal to an external device.

* * * * *